US005489099A

United States Patent [19]

Rankin et al.

[11] Patent Number: 5,489,099

[45] Date of Patent: *Feb. 6, 1996

[54] APPARATUS AND METHOD FOR TRACKING THE FLIGHT OF A GOLF BALL

[75] Inventors: David B. Rankin, Lowell, Mass.; Edgar P. Roberts, Jr.; James W. Kluttz, both of Winston-Salem, N.C.

[73] Assignee: Accu-Sport International, Inc., Winston-Salem, N.C.

[ * ] Notice: The term of this patent shall not extend beyond the expiration date of Pat. No. 5,342,051.

[21] Appl. No.: 297,645

[22] Filed: Aug. 29, 1994

Related U.S. Application Data

[63] Continuation of Ser. No. 968,994, Oct. 30, 1992, Pat. No. 5,342,051, and a continuation-in-part of Ser. No. 117,104, Sep. 10, 1993.

[51] Int. Cl.[6] ..... A63B 69/36

[52] U.S. Cl. ..... 273/185 A; 273/35 R; 273/183.1; 273/185 R; 273/32 B; 434/252

[58] Field of Search ..... 273/183.1, 184 R, 273/185 R, 35 R, 213, 185 A, 32 B; 348/157; 434/252

[56] References Cited

U.S. PATENT DOCUMENTS

| | | | |
|---|---|---|---|
| 3,194,562 | 7/1965 | Speiser . | |
| 3,508,440 | 4/1970 | Murphy . | |
| 4,005,261 | 1/1977 | Sato et al. . | |
| 4,025,718 | 5/1977 | Paretti . | |
| 4,160,942 | 7/1979 | Lynch et al. . | |
| 4,572,512 | 2/1986 | Tegart . | |
| 4,612,575 | 9/1986 | Ishman et al. . | |
| 4,673,183 | 6/1987 | Trahan . | |
| 4,695,891 | 9/1987 | Peterson . | |
| 4,713,686 | 12/1987 | Ozaki et al. . | |
| 4,774,589 | 9/1988 | Rowland . | |
| 4,858,922 | 8/1989 | Santavaci | 273/184 R |
| 4,893,182 | 1/1990 | Gautraud et al. . | |
| 4,898,388 | 2/1990 | Beard, III et al. . | |
| 5,029,866 | 7/1991 | Beard, III et al. . | |
| 5,053,876 | 10/1991 | Blissett et al. . | |
| 5,056,068 | 10/1991 | Barnes . | |
| 5,056,791 | 10/1991 | Poillon et al. . | |
| 5,075,776 | 12/1991 | Cheung . | |
| 5,101,268 | 3/1992 | Ohba . | |
| 5,102,140 | 4/1992 | Vincent . | |
| 5,160,839 | 11/1992 | Nishiyama et al. . | |
| 5,342,051 | 8/1994 | Ronkin et al. | 273/185 A |

*Primary Examiner*—Jessica J. Harrison
*Assistant Examiner*—James Schaaf
*Attorney, Agent, or Firm*—Bell, Seltzer, Park & Gibson

[57] ABSTRACT

The golf ball tracking apparatus has a video camera for producing data representative of video images of a golf ball, a video frame processor connected to receive data from the video camera for determining the golf ball image position within a video frame of the camera, a flight path predictor responsive to the video frame processor for predicting the flight path of the golf ball in response to data from the video frame processor, and a motion controller responsive to the flight path predictor for controlling the movement of the camera to thereby track the actual flight of the golf ball.

12 Claims, 4 Drawing Sheets

APPARATUS AND METHOD FOR TRACKING THE FLIGHT OF A GOLF BALL

RELATED APPLICATIONS

This application is a continuation of application Ser. No. 07/968,994 filed Oct. 30, 1992 and a continuation-in-part of application Ser. No. 08/117,104 filed Sep. 10, 1993, now U.S. Pat. No. 5,342,051.

FIELD OF INVENTION

This invention relates to a golfing apparatus and, more particularly, to an apparatus for tracking the flight of a golf ball and for providing flight path information to the golfer.

BACKGROUND OF THE INVENTION

With the advent of video cameras, a video camera user may take a continuous picture of a golf shot as the user moves the camera to track the flight of the golf ball. This manual tracking system, however, requires one or more workers and a survey transit to track and locate the golf ball. The video camera user also often has difficulty keeping track of the ball during the flight and the golfer has little or no information on the flight path of his shot.

Video cameras have been used for numerous applications in the golf industry such as for viewing golf tournaments, replaying golf shots, and viewing the golf course or shot prior to hitting the ball. Golf courses have been developed with video cameras mounted in various locations on the golf course to allow a golfer to view the ball or various scenes of a course. Examples of such golf courses may be seen in U.S. Pat. No. 4,696,474 by Tegart entitled "Golf Course" and U.S. Pat. No. 4,572,512 by Tegart entitled "Golf Course". Other devices have been developed as golf games for detecting when a golf ball has been hit and for approximating a distance that the ball would have travelled. An example of such a game may be seen in U.S. Pat. No. 3,508,440 by Murphy entitled "Golf Game".

Golf training facilities such as golf schools have become popular for teaching and training golfer's on proper golf techniques and golf shots. These training facilities, however, rely on the judgment of the staff to determine the quality of a stroke by a student. Such judgment, of course, is subjective to the particular staff person.

Further, radar systems have been used to detect the landing point of a struck golf ball. An example of such a system may be seen in U.S. Pat. No. 4,673,183 by Trahan entitled "Golf Playing Field With Ball Detecting Radar Units". Acoustic systems have also been developed for detecting the landing point of a struck golf ball. Examples of these types of systems may be seen in U.S. Pat. No. 5,029,866 by Beard, III., et al. entitled "Apparatus And Method For Determining Projectile Impact Locations"; U.S. Pat. No. 4,898,388 by Beard, III., et al. entitled "Apparatus And Method For Determining Projectile Impact Locations"; and U.S. Pat. No. 5,056,068 by Barnes entitled "Apparatus And Method For Detecting Sharp Signal Variations Against Ambient Signals" which are hereby incorporated herein by reference. These systems, however, do not actually track the flight path of the struck golf ball and do not take into account flight variations caused by a golfer's swing, such as hooking or slicing, or weather conditions of the course (i.e., wind, rain).

Although the above and other proposed systems have provided the potential for improving the sport of golf by providing to the golfer actual or approximate information on performance of the golfer, there is no commercially available apparatus that tracks the actual flight of a golf ball and provides information to the golfer about the flight path of the struck golf ball.

SUMMARY OF THE INVENTION

The invention provides an apparatus and method for tracking the flight of a golf ball and for providing flight path information to the golfer. The apparatus and method of the invention can be used with existing golf courses and driving ranges without substantial modification thereto. Moreover, the apparatus and method of the invention employ a minimum of equipment and can readily and simply be applied to golf courses and driving ranges of different designs and layouts.

The apparatus of the invention includes a video camera for producing data representative of video images of a golf ball, a video frame processor connected to receive data from the video camera for determining the golf ball image position within a video frame of the camera, a flight path predictor responsive to the video frame processor for predicting the flight path of the golf ball in response to data from the video frame processor, and a motion controller responsive to the flight path predictor for controlling the movement of the camera to thereby track the actual flight of the golf ball. The apparatus also preferably includes an image controller for adjusting the focal length of the camera lens and for focusing the camera lens in response to the flight path predictor.

In operation of the system, the flight path predictor allows the apparatus to predict the flight path of the ball based on previous flight information. This allows economical use of relatively slow video frame processing rates by taking advantage of the relatively consistent flight path of the ball. In brief, because the apparatus predicts where the ball is headed, it is not necessary to continuously move the camera focus to the last known ball position. Instead, the camera is always moving with the ball and, with minor corrections to the camera motion made by signals from the flight path predictor, the ball always remains in the frame.

At an initial starting point, the golf ball is mounted on a tee in the tee area of a driving range or golf course. The camera lens of the camera, in turn, is mounted facing the tee for initially tracking the golf ball. The golf ball is hit by the golfer, and the camera is moved by the system of the invention to track the ball flight. As the ball moves in flight, the image controller adjusts the camera zoom to keep a substantially consistent ball image size and also preferably adjusts the focus of the camera to maintain a quality image of the golf ball. As the golf ball contacts the ground or comes to a rest, the landing point of the ball is recorded. The flight path is then analyzed and the information about the flight path is sent to the golfer or user of the system. If another golf ball is hit, the camera is again moved toward the tee, and the process is started over again.

DESCRIPTION OF THE DRAWINGS

Some of the objects and advantages of the present invention having been stated, others will become apparent as the description proceeds when taken in conjunction with the accompanying drawings, in which.

DETAILED DESCRIPTION OF A PREFERRED EMBODIMENT

The present invention now will be described more fully hereinafter with reference to the accompanying drawings in which a preferred embodiment of the invention is shown. This invention may, however, be embodied in many different forms and should not be construed as limited to the embodiment set forth herein; rather, this embodiment is provided so that this disclosure will be thorough and complete, and will fully convey the scope of the invention to those skilled in the art. Like numbers refer to like elements throughout.

Figure 1:
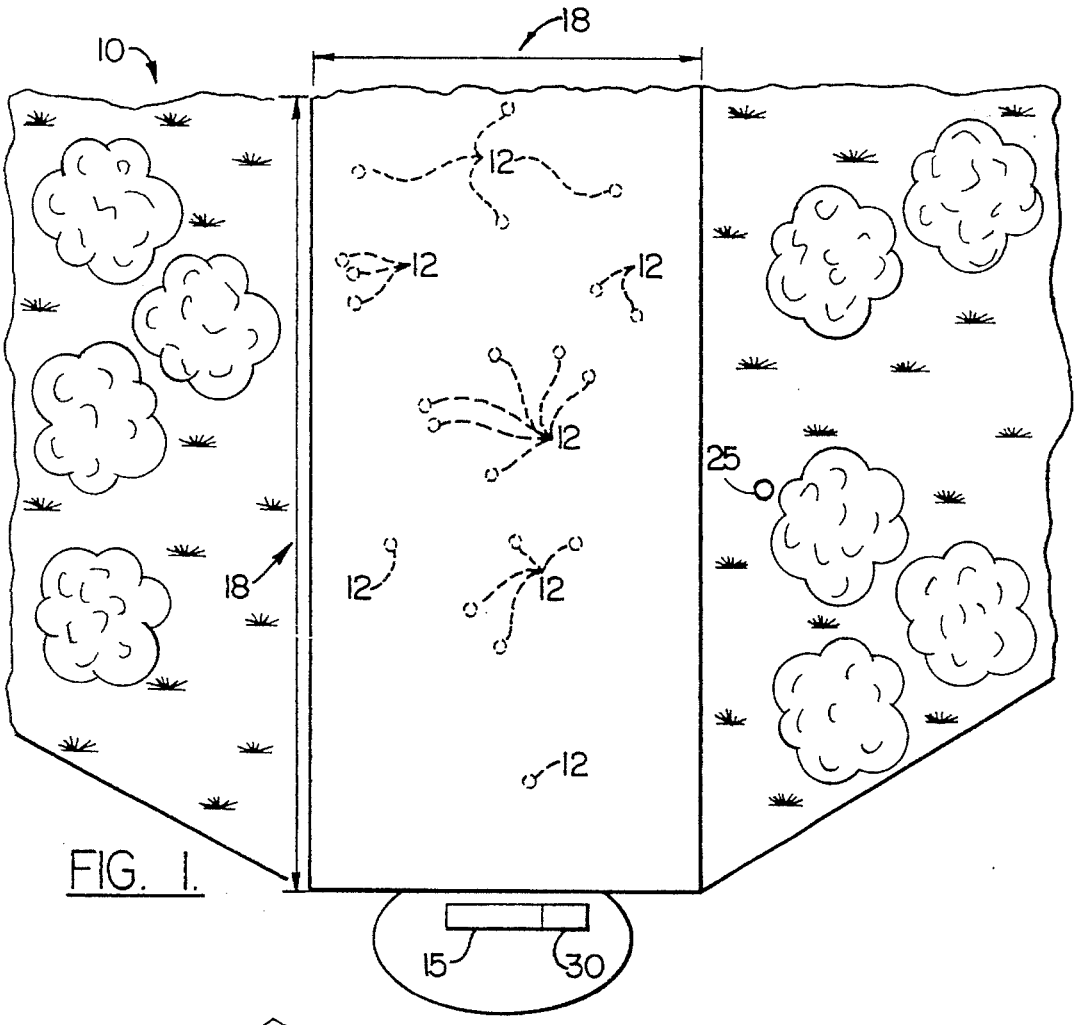
FIG. 1 is a top view of a golf range having the video camera for tracking the flight of a golf ball and a computer terminal according to the present invention.

Referring more particularly to the drawings, FIG. 1 is an environmental view of a golf range 10 having the golf ball tracking apparatus 20 according to the present invention. A golf ball, several of which are depicted in phantom view generally at 12, is hit from a tee area shown at 15 into the range area 18. The golf ball 12 is tracked by the golf ball tracking apparatus 20 from the initial contact point with a golf club until the ball hit the ground somewhere in the range area 18. The golf ball tracking apparatus 20 has a video camera 25 (further shown in FIG. 2A) mounted to a gimbal 28 and to a pole 29. The camera 25 is mounted and positioned so that it may selectively move to view the range area 18 for the typical flight paths for the golf ball 12. A computer display terminal 30 is typically located near the golfer to provide information analysis and feedback to the golfer on the actual flight path of the golfer's shots.

Figure 2A:
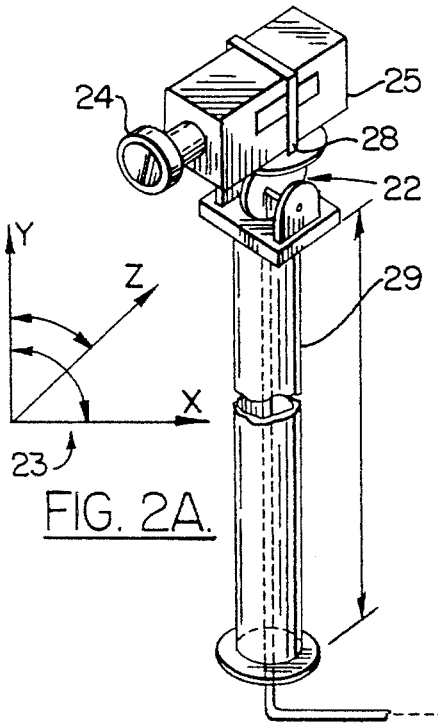
FIGS. 2A and 2B are perspective views of the video camera and the computer display terminal as illustrated in FIG. 1.
Figure 2B:
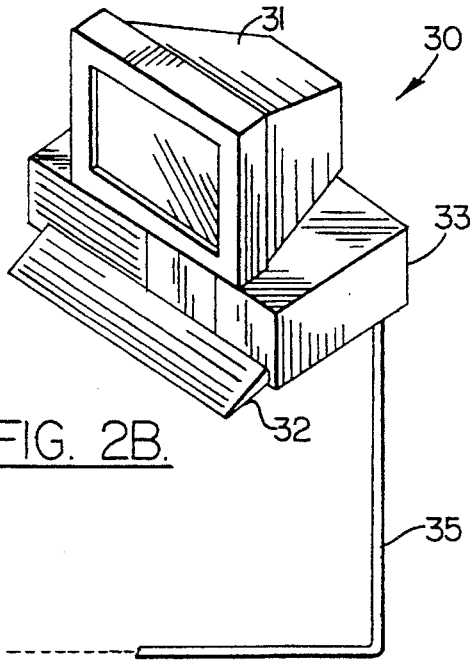

FIGS. 2A and 2B are perspective views of the video camera 25 and the computer display terminal 30 as indicated in FIG. 1 according to the present invention. These views further illustrate the mounting of the video camera 25 on the gimbal 28 and the pole 29. The X-Y-Z axis shown at 23 illustrates the general directional movement capabilities of the camera 25. The directional movement typically allows rotation of the camera 25 through 90 degrees in the X-Y plane and 90 degrees in the Y-Z plane. This direction movement is controlled by a motion controller 26 which also provides image stabilization during camera movement. Also, various mounting hardware is also shown at 22 for mounting and assisting in the camera movement. The camera 25, in this embodiment, also has an image controller 27 for focusing a camera lens 24 of the camera 25 on the golf ball 12 and for controlling the zoom or magnification for the camera lens 24 sufficient to maintain a consistent ball image size within a video frame produced from the data representative of video images of the golf ball 12.

The computer display terminal 30 of FIG. 2B has a display monitor shown in the form of a cathode ray tube ("CRT") 31 for displaying data about the golfer's shot, a keyboard 32 for allowing the golfer or user to interface with the computer display terminal 30, and a central processing unit ("CPU") 33 which may be used for information analysis and/or data processing of information about the golfer's shot. The computer display terminal 30 may also include a printer (not shown) for printing information about the golfer's shot. The CPU 33 of the computer display terminal 30 may perform various processing and control functions as it communicates with the camera 25 via a communication link generally indicated by wires 35. It will also be understood by those skilled in the art that a CPU or microprocessor may be located in or around the camera 25 to perform part or all of the process and control functions as discussed further below.

Figure 3:
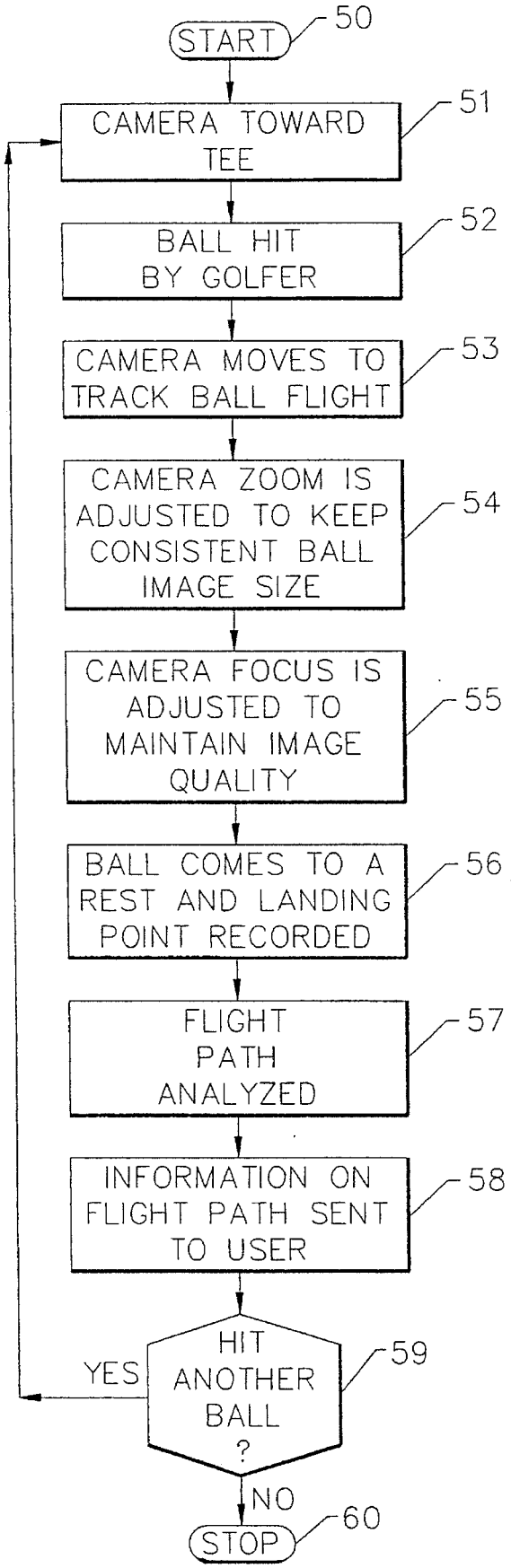
FIG. 3 is a schematic block diagram illustrating the tracking of a golf ball.

FIG. 3 is a schematic block diagram illustrating the steps, as depicted by blocks 50–60, for tracking of the golf ball 12 as provided by the golf ball tracking apparatus 20. At an initial starting point 50, the golf ball 12 is mounted on a tee in the tee area 15. The camera lens of the camera 25, in turn, is facing the tee as indicated in block 51 for initially tracking the golf ball 12. The golf ball 12 is hit by the golfer, as shown by block 52, and the camera moves to track the ball flight 53. The tracking of the ball 12 may be initiated by an acoustic sensor of visual sensor (e.g., laser) or simply by the initial movement of the ball 12. As the ball moves in flight, the image controller 27 adjusts the camera zoom to keep a substantially consistent ball image size and also adjusts the focus of the camera 25 to maintain a quality image of the golf ball 12 as shown in blocks 54 and 55. As the golf ball 12 contacts the ground or comes to a rest, the landing point of the ball is recorded 56. The flight path is then analyzed 57 and the information about the flight path is sent to the golfer or user of the system 58. If another golf ball 12 is hit, as shown in block 59, the camera 25 is again moved toward the tee, as shown in block 51, and the process is started over again. If another golf ball 12 is not hit, then the operation is stopped as shown in block 60.

Figure 4:
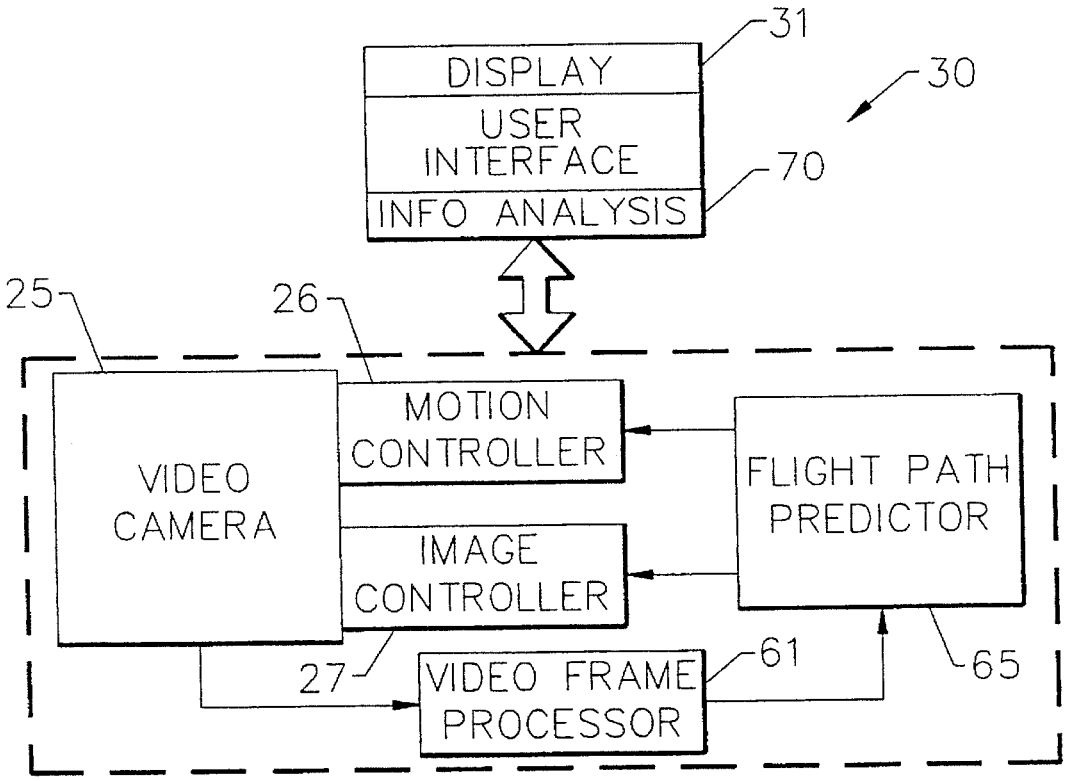
FIG. 4 is a schematic block diagram of the golf ball tracking apparatus according to the present invention.
Figure 5:
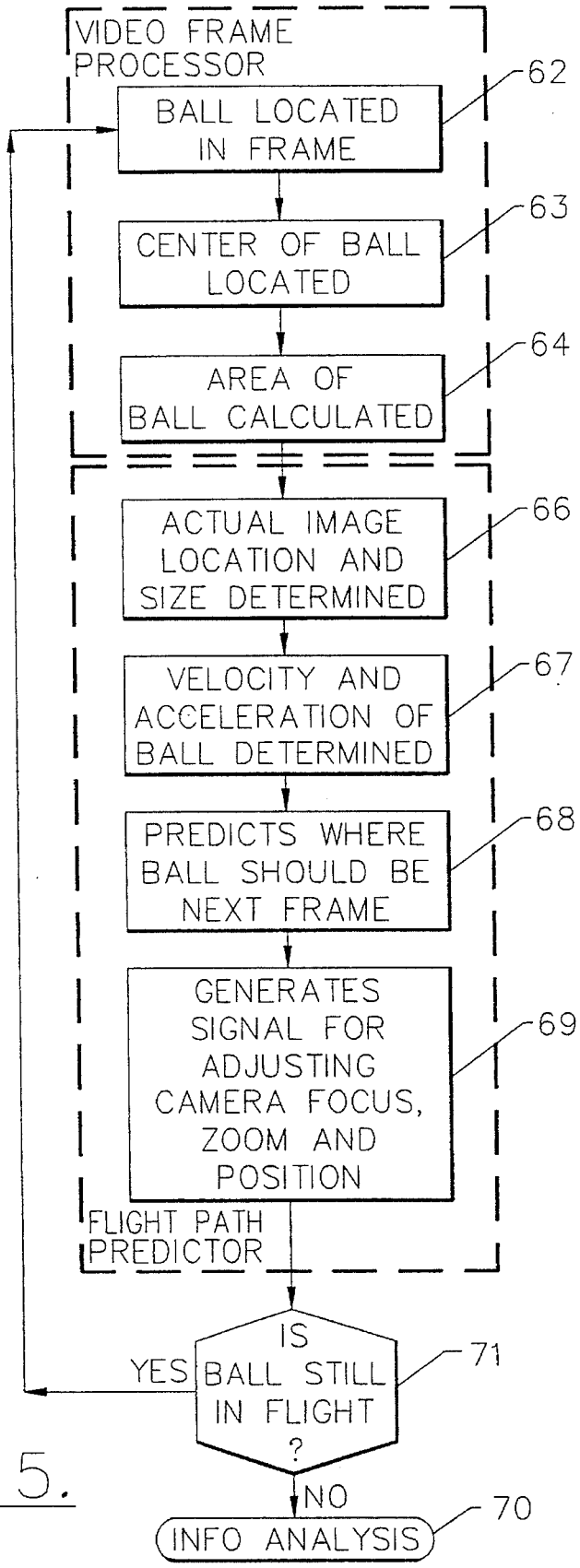
FIG. 5 is a schematic block diagram illustrating the information processing of the video frame processor and the flight path predictor according to the present invention.

FIGS. 4 and 5 further illustrate the control functions of various details of the golf tracking apparatus 20. FIG. 4 is a schematic block diagram of the golf ball tracking apparatus 20 according to the present invention. The block indicated by the dashed lines illustrates the control operation for the video camera 25 of the tracking apparatus 20. The video camera 25 produces data representative of video images of the golf ball 12 from the initial contact point with a golf club to when the ball 12 contacts the ground and comes to rest as discussed in FIG. 3 above. The data produced by the camera 25 is typically in digital format, but it will be understood by those well skilled in the art to use other formats such as a combination of analog and digital as well.

Referring again to FIG. 4, the video frame processor 61 connected to the video camera 25 receives data from the camera 25 to thereby determine the golf ball image position within a video frame of the camera 25. The flight path predictor 65 responds to the video frame processor 61 to predict a flight path of the golf ball 12 in response to the data from the video frame processor 61. The motion controller 26, in turn, responds to the flight path predictor 65 to control the movement of the camera 25 to track the actual flight of the golf ball 12. The image controller 27 also responds to the flight path predictor 65 to adjust the focal length of a camera lens 24 and for focusing the camera lens 24 in response to the flight path predictor 65. The image controller 27 has a zoom lens controller 41 and a focusing controller 42 for controlling the image produced by the camera 25.

FIG. 5 is a schematic block diagram illustrating the information processing of the video frame processor 61 and the flight path predictor 65 according to the present invention. These functions may be performed preferably by a microprocessor based system, but other types of data processing circuits apparent to those skilled in the art may also be used. The video frame processor 61 receives data from the video camera 25 representative of a video frame. As the video frame information arrives at the video frame processor 61, the golf ball 12 is identified and located within the frame by use of recognition techniques understood by those skilled in the art. The center of the golf ball image is located and used as a reference point. The area of the golf ball image is then calculated by counting the number of pixels which cover the image. The reference point and area of the golf ball image is then passed to the flight path predictor 65.

The flight path predictor 65 determines the location and size of the actual image and the position of the camera 25. The actual location of the golf ball 12 is calculated based on the number of pixels occupied by the ball 12 in a particular video frame and on the degree of zoom of the lens. This information is compared to one or more previous positions of the golf ball 12 over time to calculate the flight velocity and acceleration of the golf ball 12 using known laws of physics that a moving object travels in a continuous path until it strikes another object, in this case the ground. The velocity and acceleration is then used to predict where the golf ball 12 will be in a subsequent video frame, for example, in an immediately or a closely subsequent frame. A feedback loop uses the previous flight path information from previous video frames and thereby allows the flight path prediction to be modified as outside factors such as the wind and spin on the ball 12 affect the actual flight path. This allows the camera's motion to be modified rather than its position.

Horizontal and vertical predictor functions are then used for predicting where the golf ball 12 should be in the next frame; or in a subsequent future frame calculated, for example, based on a predetermined time lapse from the present frame. This calculation of the future ball position is made in response to the velocity and acceleration to thereby send command signals to the motion controller 26 for controlling the horizontal and vertical motion of the camera 25. It will be apparent to those skilled in the art that the subsequent ball location prediction will be made for a future time corresponding to a subsequent frame which is a predetermined number of frames subsequent, from one to a plurality. The number of frames subsequent can be determined by the frame processing rate, the speed of the ball 12, the speed of camera movement, image stabilization desired, or the distance of the camera 25 from the ball 12. The number of subsequent frames for prediction purposes may be a preset number or may be variable. The calculation is made so that the future frame is not too far ahead or too far behind the actual ball flight.

Also, the predicted flight path of the ball 12 may be represented by a second order equation. If the ball were tracked exclusively on its position, it would be necessary to select a frame rate that would not allow the ball 12 to traverse more than half of the image between two frames. If a slower rate were chosen, the ball 12 would leave the frame entirely and never be recaptured. The use of predictor functions allows the apparatus to make advance calculations about the flight path of the ball 12 based on previous flight information. This, in turn, allows the video frame processing rate to be slower by taking advantage of the relatively consistent flight path of the ball 12. Since the apparatus can accurately predict where the ball 12 is headed, it is not necessary to always keep the camera lens 24 on the ball 12. Instead, the camera is always moving with the ball and, with minor corrections to the camera motion made by signals from the flight path predictor 65, the ball will always be in the frame.

The predictor functions also allow the motion control system of the camera 25 to be simplified. Without the predictor functions, the gimbal 28, for example, would be moved in a start/stop fashion. Since higher frame processing rates would be required, the gimbal 28 would have to be accelerated and decelerated very quickly and very accurately. The predictor function allows the gimbal 28 to be operated in a smooth, continuous manner which makes a much lower demand on the control motors and electronics of the apparatus.

The horizontal function for predicting the horizontal motion of the golf ball may be based upon the following equation:

$$\Theta = \arctan \frac{k - (v\sin(\omega) - b)t}{j}$$

where:

v is the initial velocity;

t is the time in flight;

b is a function of t that describes the decay of ball speed;

k is the downrange position of the camera; and j is the offline distance of the camera.

The function that is represented by b may be defined several ways, each involving greater levels of accuracy. The first is a constant that is the coefficient of drag and which can be determined experimentally as will be apparent. The next order equation takes into account the lift produced by the ball spin and can also be determined by actual flight information.

The vertical function for predicting the vertical position of the golf ball may be based on the following equation:

$$\alpha = \arctan \frac{k - vt\cos(\omega) + gt^2}{j}$$

where:

v is the initial velocity of the ball;

t is the time in flight;

g is the acceleration of gravity;

k is the downrange position of the camera; and j is the offline distance of the camera.

From the predictor functions, a signal is then generated for adjusting the camera focus, zoom, and position in response to the flight path predictor. As indicated above, the motion is controlled to point the lens 24 toward the expected position of the golf ball 12 at an appropriate future time. The zoom is adjusted to keep a consistent ball image size within the video frame. The focus is adjusted to maintain a quality ball image for calculating the area of the ball 12 by the number of pixels occupied.

The predictor functions rely on the fact that the flight path is mathematically continuous. When the ball 12 hits the ground, however, this is no longer true. This point is also the lowest velocity point of the flight path. If further tracking is desired, it is important that the video frame processing rate be sufficient at this point to not lose track of the ball 12 once it hits the ground. It will also be apparent to those skilled in the art that various other types of horizontal and vertical predictor functions, and other techniques for predicting flight path, may also be used, including various sampling and over-sampling predicting techniques.

Information analysis 70 is then performed on the movement and position of the camera 25 for determining the actual golf ball flight path to be communicated to the golfer. The information is obtained by tracking and calculating the actual distance of travel of the golf ball 12 and the angular attitude of the golf ball 12. The information analyzer 70, shown in FIG. 4, performs various data processing calculations to thereby determine information about the golf shot to be communicated to the golfer. For example, information about a golfer's hook, slice, distance, height, effects of outside forces, various mapping of shots, or other functions may be performed and displayed or otherwise provided to the golfer. The flight path of the ball 12 contains only one discontinuity which is the point at which the ball 12 hits the ground. For some of the information desired, this is the point of interest. By locating the discontinuity, the point of contact with the ground may be obtained.

It will be apparent to those skilled in the art that various changes and modifications can be substituted for those parts of the system described herein. For example, a video camera system could be combined with the acoustic systems, as described in U.S. Pat. Nos. 5,056,068, 5,029,866, or 4,898,388, to provide a combination camera and acoustic golf ball tracking apparatus.

In the drawings and specification, there have been disclosed typical preferred embodiments of the invention and, although specific terms are employed, they are used in a generic and descriptive sense only and not for the purposes of limitation. The invention has been described in considerable detail with specific reference to various preferred embodiments. It will be apparent, however, that various modifications and changes can be made within the spirit and scope of the invention as described in the foregoing specification and defined in the appended claims.

That which is claimed is:

1. An apparatus for evaluating the complete flight path of a golf ball during actual flight, comprising:

a video camera positioned for producing data representative of video images of a complete flight path of a golf ball;

processing means connected to receive data from said video camera for determining a golf ball image position within a video frame of said camera;

predicting means responsive to said video frame processing means for predicting the flight path of the golf ball;

image control means responsive to said predicting means for adjusting the focal length of the camera lens and for focusing the camera lens on the golf ball; and determining means responsive to said predicting means for determining the actual flight path of the golf ball.

2. The apparatus according to claim 1, wherein said image control means comprises a zoom lens controller and a focusing controller.

3. The apparatus according to claim 1, wherein said determining means comprises:

distance determining means for determining an actual distance of travel of the golf ball; and angular attitude determining means for determining an actual angular attitude of the golf ball.

4. The apparatus according to claim 1, further comprising communication means for communicating actual flight path information to the golfer.

5. The apparatus according to claim 4, wherein said communication means comprises a display monitor.

6. A method of tracking a golf ball during actual flight, comprising the steps of:

producing data representative of a video image of a golf ball during actual flight by use of a video camera;

predicting a flight path of the golf ball responsive to the data representative of the video image; and adjusting the predicted flight path in response to the actual flight path of the golf ball.

7. The method according to claim 6, wherein said producing a video image step comprises the steps of:

locating the golf ball within a video frame;

locating the center of the golf ball within the video frame; and determining the area of the ball in response to its location and center within the video frame.

8. The method according to claim 6, wherein said flight predicting step comprises the steps of:

determining the velocity and acceleration of the golf ball; and predicting the location of where the ball should be in a subsequent video frame.

9. A method of evaluating of a golf ball during actual flight, comprising the steps of:

producing data representative of a video image of a golf ball during actual flight by directing a video camera toward a struck golf ball;

predicting a flight path of a golf ball responsive to the data representative of the video image;

adjusting the predicted flight path in response to the actual flight path of the golf ball; and determining the actual flight path of the golf ball.

10. The method according to claim 9, wherein said producing a video image step comprises the steps of:

locating the golf ball within a video frame;

locating the center of the golf ball within the video frame; and determining the area of the ball in response to its location and center within the video frame.

11. The method according to claim 9, wherein said flight predicting step comprises the steps of:

determining the velocity and acceleration of the golf ball;

predicting the location of where the ball should be the next video frame; and generating a signal for moving the camera in response to the predicted location.

12. The method according to claim 9, further comprising the step of communicating the flight path of the golf ball to a golfer.

* * * * *